US008393980B2

(12) United States Patent
Chen

(10) Patent No.: US 8,393,980 B2
(45) Date of Patent: Mar. 12, 2013

(54) SWING BALL TRAINING DEVICE WITH ADJUSTABLE HEIGHTS AND VARIED SWINGS

(76) Inventor: Yung-Chien Chen, Taipei (TW)

( * ) Notice: Subject to any disclaimer, the term of this patent is extended or adjusted under 35 U.S.C. 154(b) by 337 days.

(21) Appl. No.: 12/839,392

(22) Filed: Jul. 19, 2010

(65) Prior Publication Data

US 2011/0281671 A1 Nov. 17, 2011

(30) Foreign Application Priority Data

May 12, 2010 (TW) ..... 99208804 U

(51) Int. Cl.
*A63B 69/00* (2006.01)
*A63B 71/00* (2006.01)

(52) U.S. Cl. ..... 473/417; 473/422

(58) Field of Classification Search ..... 473/417, 473/423, 420, 421, 446, 438, 445, 443, 145, 473/426; D21/717
See application file for complete search history.

(56) References Cited

U.S. PATENT DOCUMENTS 2,862,712 A * 12/1958 Delia et al. ..... 473/423
3,874,662 A * 4/1975 Harrington ..... 473/417
4,490,934 A * 1/1985 Knapp ..... 40/603
4,681,318 A * 7/1987 Lay ..... 473/423
4,830,371 A * 5/1989 Lay ..... 473/423
4,938,478 A * 7/1990 Lay ..... 473/423
6,358,163 B1 * 3/2002 Tanner ..... 473/417
2003/0032506 A1 * 2/2003 Chi ..... 473/417
2010/0058635 A1 * 3/2010 Knapp et al. ..... 40/607.01
2011/0281671 A1 * 11/2011 Chen ..... 473/417

* cited by examiner

*Primary Examiner* — Gene Kim
*Assistant Examiner* — M Chambers
(74) *Attorney, Agent, or Firm* — Rosenberg, Klein & Lee

(57) ABSTRACT

An improvement of a swing ball device with adjustable heights for hitting practice, featured with varied swing frequencies and paths to enrich training, includes an elastic swing piece associated with a ball disposed in a supporting cup. By the elastic swing motion of the swing, the ball is able to swing left and right in a three-dimensional plane. The swing piece is disposed with one or more interval holes for connecting with pipes of different heights, depending on weights of the ball and a user's preference. The two lateral securing ears helps to secure the ball inside the supporting cup from falling off. The swing piece when coordinated with a through-pin or a compressed plate produces motions of different angles and frequencies in swing, facilitating training in the coordination of hands, eyes, and the brain.

4 Claims, 10 Drawing Sheets

SWING BALL TRAINING DEVICE WITH ADJUSTABLE HEIGHTS AND VARIED SWINGS

BACKGROUND OF INVENTION

1. Field of Invention

The present invention relates to a free style self-swinging ball device for baseball training, and, more particularly, to an elastic ball device with adjustable device heights, which provides variable swinging paths of different swing frequencies to fully stimulate a user's instant reaction to the hardly predictable swinging path of the ball.

2. Related Prior Art

Due to rapid development in high-tech industry, time to stay in an air-conditioned office for the working class inevitably increases, adversely raising the health issue. Popular exercising sports, such as U.S. Pat. Nos. 7,704,168, 6,884,185, 2,527,906, 7,303,494, 6,612,943, and 7,226,372, all provide a static ball device disposed with a ball allowing a user to manually adjust the physical position of the ball for practice bat swinging. Furthermore, the bat seat fails in general to secure the ball safely in the seat.

The function of a conventional stationary ball device for baseball training purpose is limited in lacking a real-time simulation of the hardly predictable moving path of a ball. The instant invention is designed to overcome the above limitation.

SUMMARY OF INVENTION

It is therefore the objective of the present invention to provide a swinging ball device for sports training purpose, which provides a varied dynamic path for a user to best simulate the real-time movement of a ball.

The second objective is to present a batting practice device which is capable of a two-dimensional elastic swinging for a ball disposed in the supporting cup to move likewise.

The third objective is to provide a swing ball device with interval holes disposed on the swing piece for adjusting the overall height of the baseball device relative to the hitting position, depending on different weights of the ball and a user's preference.

To achieve the foregoing objectives, the preferred embodiment of the instant invention includes a supporting cup, an upper connecting pipe, a lower connecting pipe, an upper pipe sleeve, a swing piece, a lower pipe sleeve, a bat seat, and a stopping ring.

Furthermore, the two arc laterals along the two sides of the supporting cup extend upwards, offsetting the eccentricity force of the ball when a user moves the device for a initial start-up shake before the first hit and also after each hit. The two lateral securing ears extending in the direction towards the center of the ball further helps to secure the ball from falling off the supporting cup while the ball is in a three-dimensional motion.

DETAILED DESCRIPTION OF PREFERRED EMBODIMENT

Figure 1:
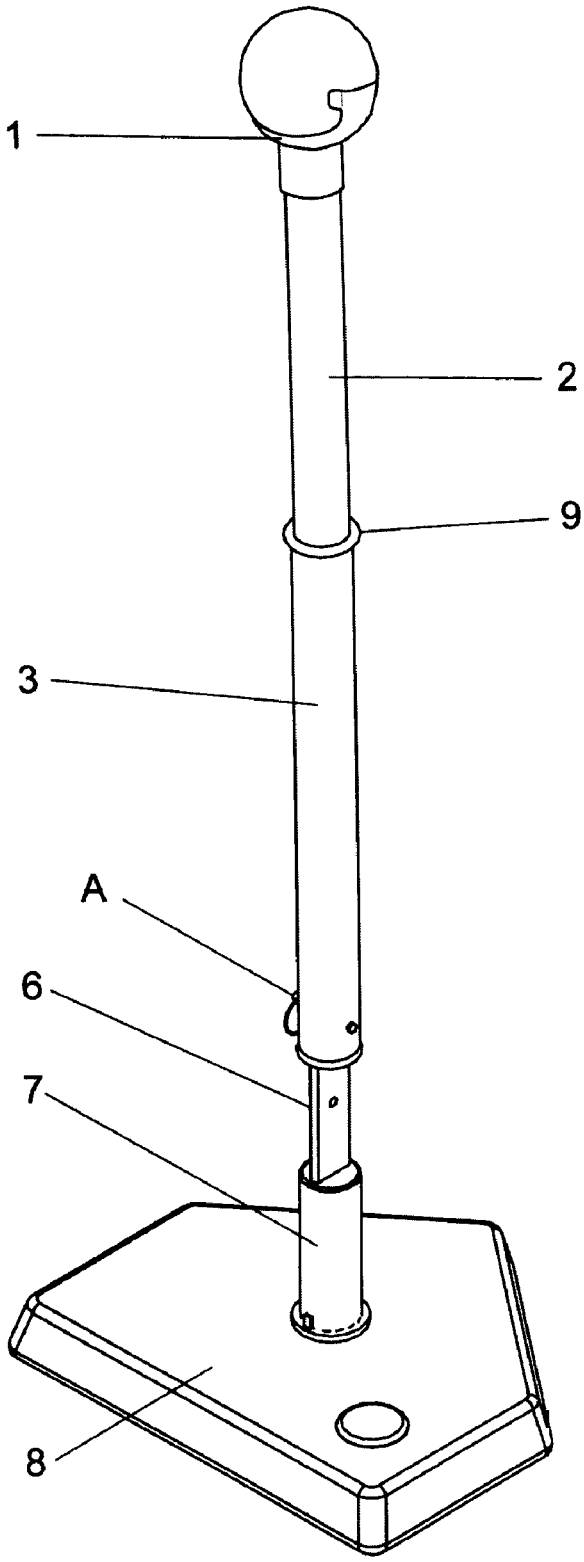
FIG. 1 is a three-dimensional view for the preferred embodiment of the invention.
Figure 2:
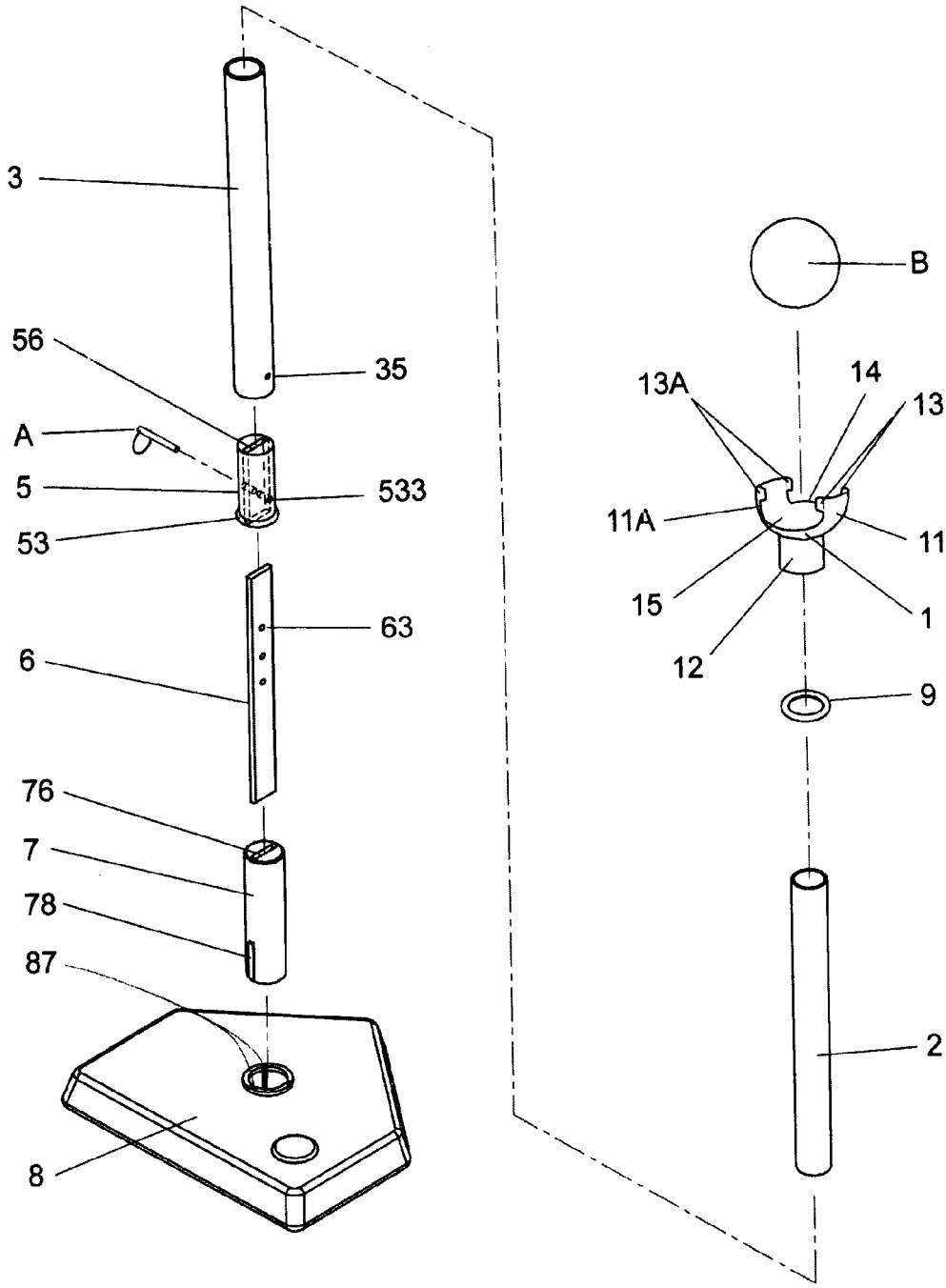
FIG. 2 is an exploded view of the preferred embodiment of the invention.
Figure 3:
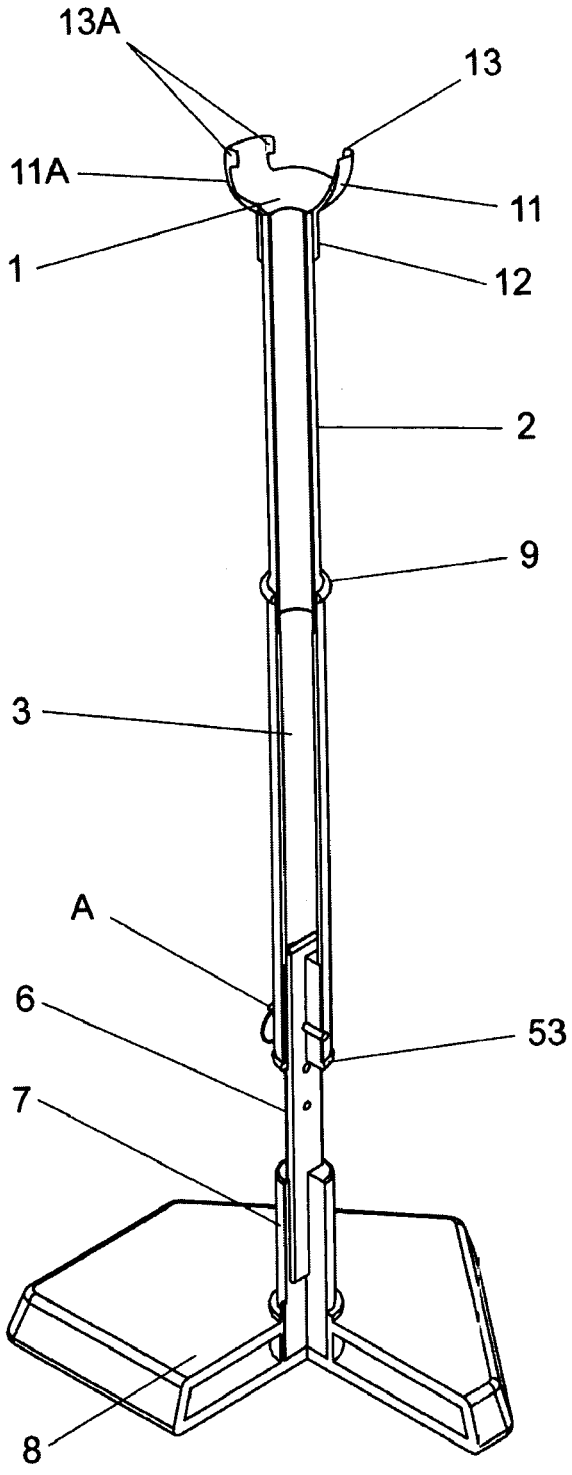
FIG. 3 is a three-dimensional sectional view for the preferred embodiment of the invention.
Figure 4:
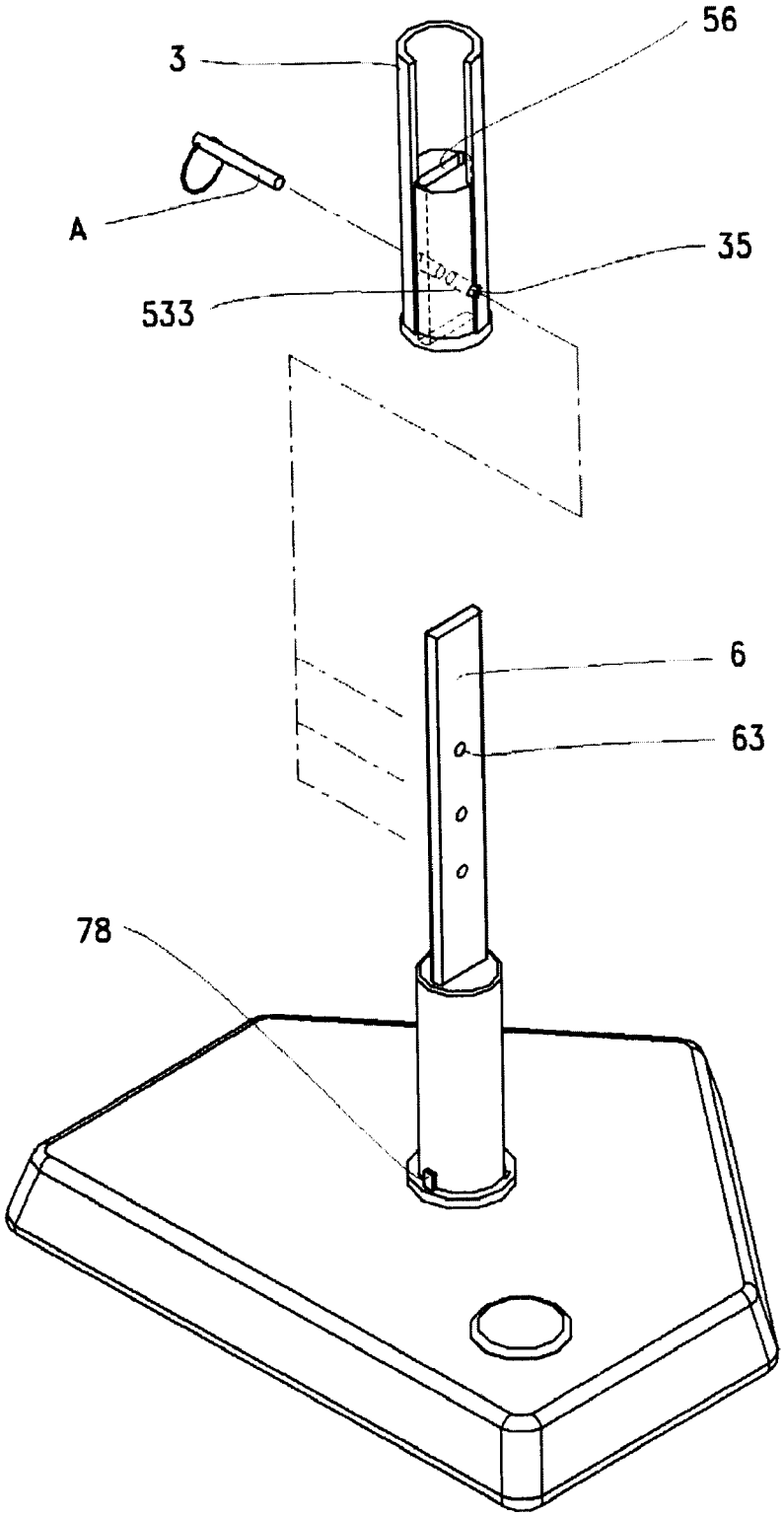
FIG. 4 illustrates interval holes of the swing piece which provide adjustable varied positioning for the swing piece for producing swing motions of different swing ranges.

Referring to FIG. 1 to 7 for the preferred embodiment of the instant invention. A self-swinging bat, disclosed in the instant application, includes a supporting cup (1), an upper connecting pipe (2), a lower connecting pipe (3), an upper pipe sleeve (5), a swing piece (6), a lower pipe sleeve (7), a device seat (8), and a stopping ring (9).

The supporting cup (1) is made of soft materials and opens upwards, including the two arc laterals (11) and (11A) of the supporting cup (1) extending upward along the shape of the ball (B) to over one half of the vertical height (or diameter) of the ball (B). Each of two arc laterals (11) and (11A) further includes two lateral securing ears (13) and (13A) extending from the upper part of the arc laterals (11) and (11A) along the direction to the center the ball. The two lateral securing ears (13) and (13A) help to secure the ball (B) from falling off the supporting cup (1) when the device is in swinging. The batting opening (15) corresponds to the ball exit opening (14).

Different from what is disclosed in US2006/0258485A1, in the instant invention, the width of the batting opening (15) and that of the ball exit opening (14) is about one-fourth of the diameter of the ball (B), allowing for substantial amount of the ball (B) being exposed outside of the two arc laterals (11) and (11A) to facilitate hitting the ball (B).

A cup sleeve (12) extending downwards from the supporting cup (1). The upper connecting pipe (2) is hollow within, with its upper section inserting into the cup sleeve (12). The lower connecting pipe (3) is also hollow within, with its upper section receiving the lower section of the upper connecting pipe (2). A lower connecting pipe through hole (35) is disposed at the bottom of the lower connecting pipe (3).

The upper pipe sleeve (5) is inserted into the lower section of the lower connecting pipe (3). At the bottom of the upper pipe sleeve (5) is disposed an extended ring (53) to be in direct contact against the lower end of the lower connecting pipe (3). The upper pipe sleeve (5) further includes an upper pipe sleeve hole (533) for corresponding to the lower connecting pipe through hole (35), and a rectangular thorough hole (56) around the center of the upper pipe sleeve (5) whose disposition is vertical to that of the upper pipe sleeve hole (533).

The swing piece (6) is an elastic rectangular piece corresponding to the rectangular swing thorough slot (56), with its upper section inserting into the rectangular swing thorough slot (56); the swing piece (6) further includes a plurality of interval holes (63) which correspond to the lower connecting pipe through hole (35) of the lower connecting pipe (3) and to the upper pipe sleeve hole (533) of the upper pipe sleeve (5), for allowing a through-pin (A) to enter and be secured within for adjusting the vertical disposition of the swing piece (6).

The lower pipe sleeve (7) is disposed with a rectangular sleeve through slot (76) for securing the lower end of the swing piece (6), and a vertical-oriented extension (78) for positioning.

The bat seat (8) is shaped like a traditional home plate in baseball games, including a plurality of recesses with different orientations for securing the vertical-oriented extension (78) of the lower pipe sleeve (7).

The stopping ring (9) is an elastic ring sleeved onto the upper connecting pipe (2) and exposed outside of the upper connecting pipe (2), constituting one of the most distinguishing features of the instant invention.

In essence, the upper end of the swing piece (6) is inserted into the upper pipe sleeve (5) while the lower end of the swing piece (6) is inserted into the lower pipe sleeve (7). Alternatively, the swing piece (6) can be integrated with the lower pipe sleeve (7) in manufacturing. Due to the elasticity of the swing piece (6), the ball (B) disposed in the supporting cup (1) is able to swing Left and right in a two-dimensional plane. The swing piece (6) can further be disposed with a plurality of interval holes, coordinating with a through-pin (A) or a compressed plate shown in FIG. 10 for different positioning of the swing piece (6) to produce swings of different paths and frequencies, depending upon the weights of the ball (B) and a user's preference for a particular height of the swing ball device.

Figure 5:
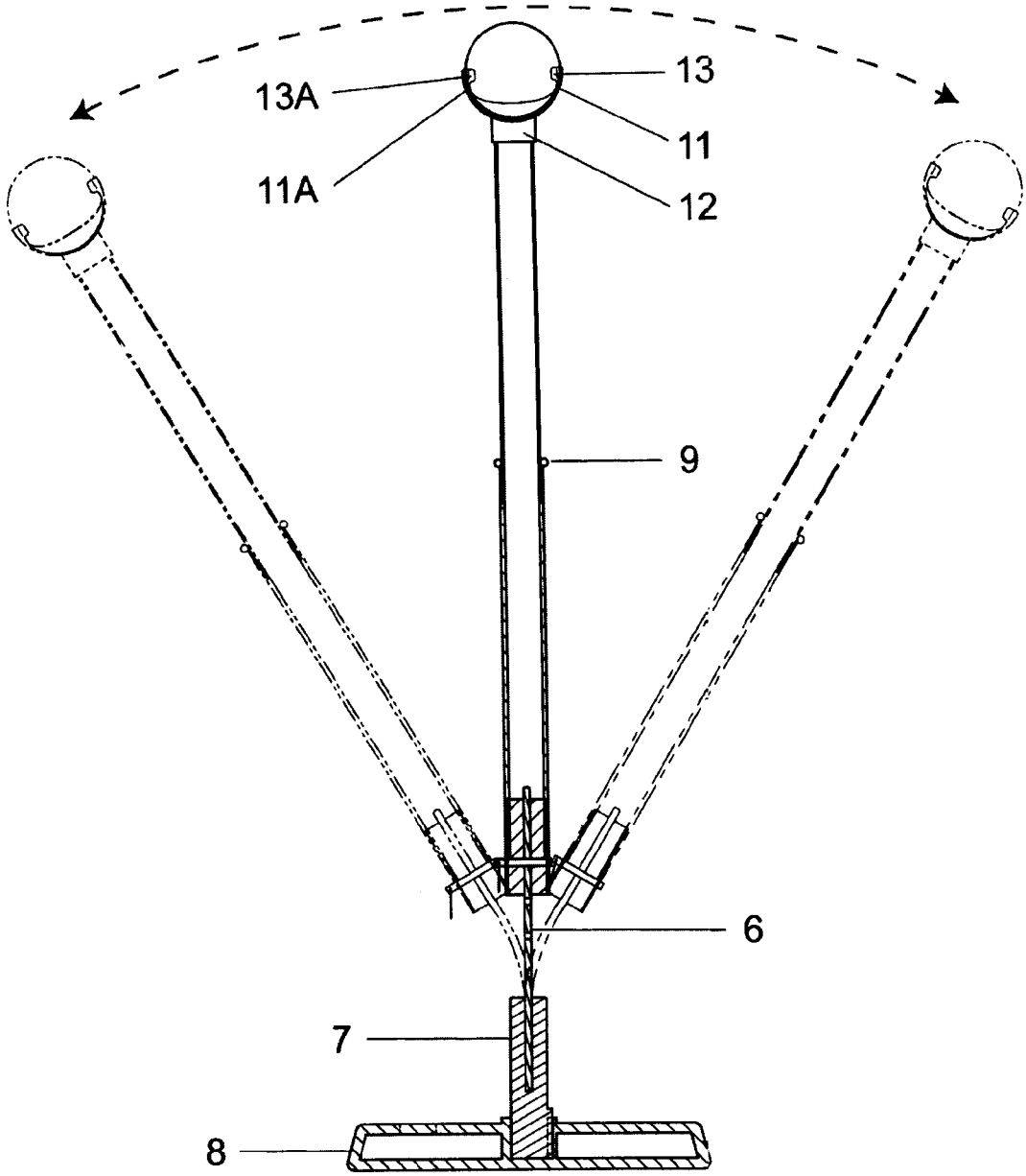
FIG. 5 illustrates the left-and-right swing of the swing piece in a two-dimensional plane.
Figure 6:
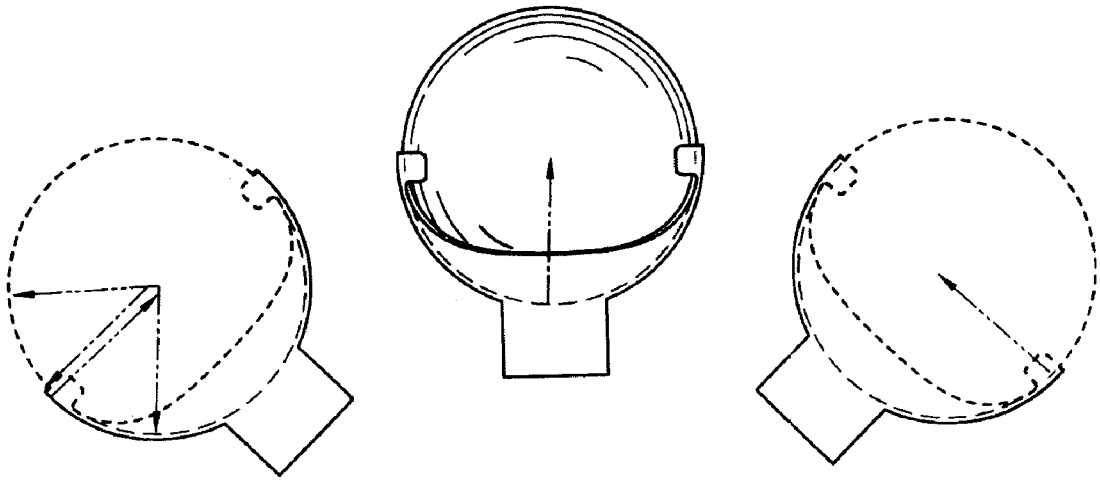
FIG. 6 illustrates the two arc laterals along two sides of the supporting cup extending upwards to offset the eccentricity force of the ball when a user moves the device for a initial start-up shake before the first hit and also after each hit.
Figure 7:
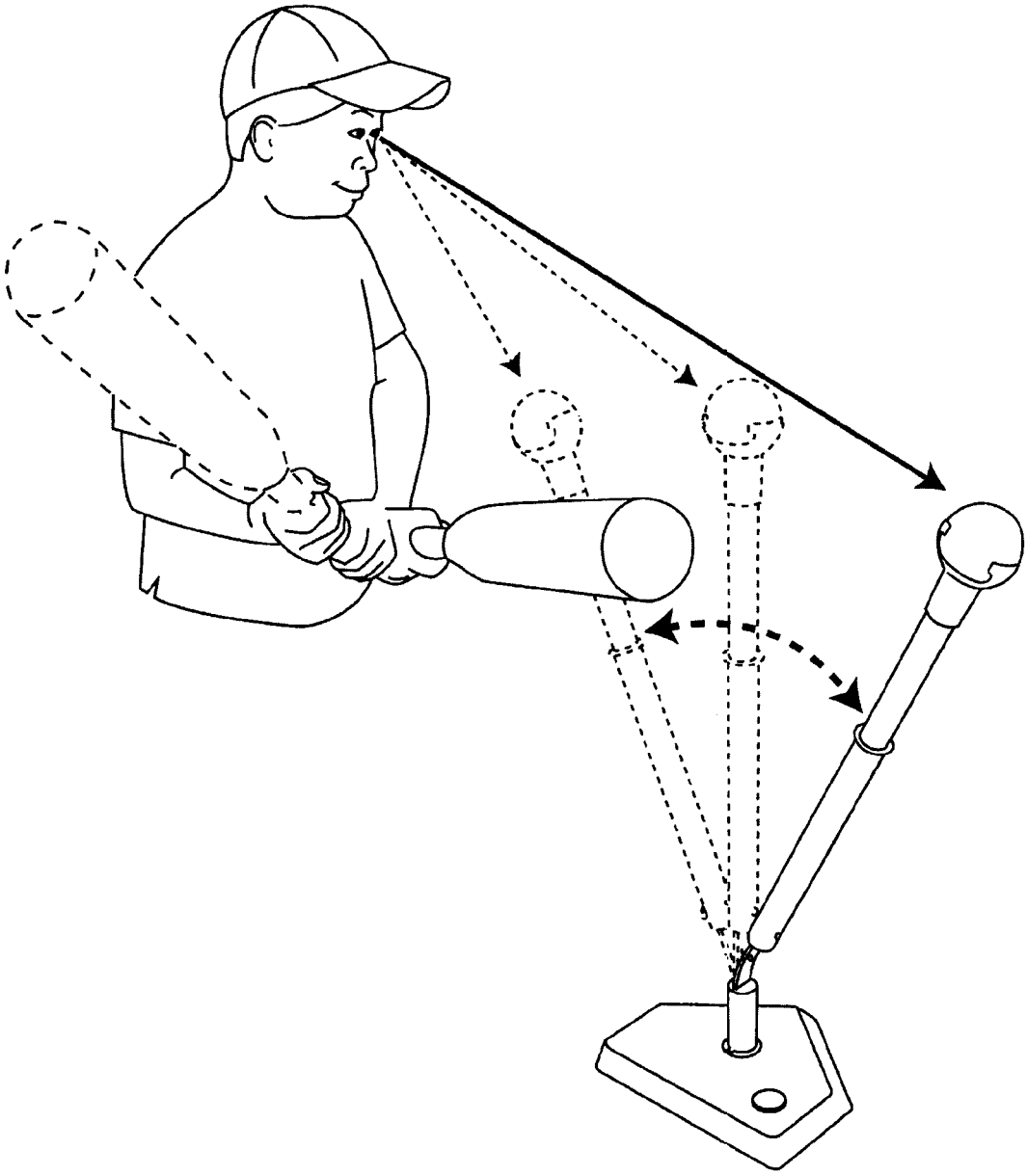
FIG. 7 illustrates the swing ball device disclosed in the invention when in use.

Furthermore, the two arc laterals (11) and (11A) of the supporting cup 1 provides a substantial supporting force to reduce the eccentric force when the ball (B) is in a initial start-up shake and also after each hit by the user's bat, maintaining the on-going left-and-right swing motion of the ball (B) as shown in FIG. 5 6, and facilitating the real-time simulation of a dynamic ball movement, as shown in FIG. 7.

Figure 8:
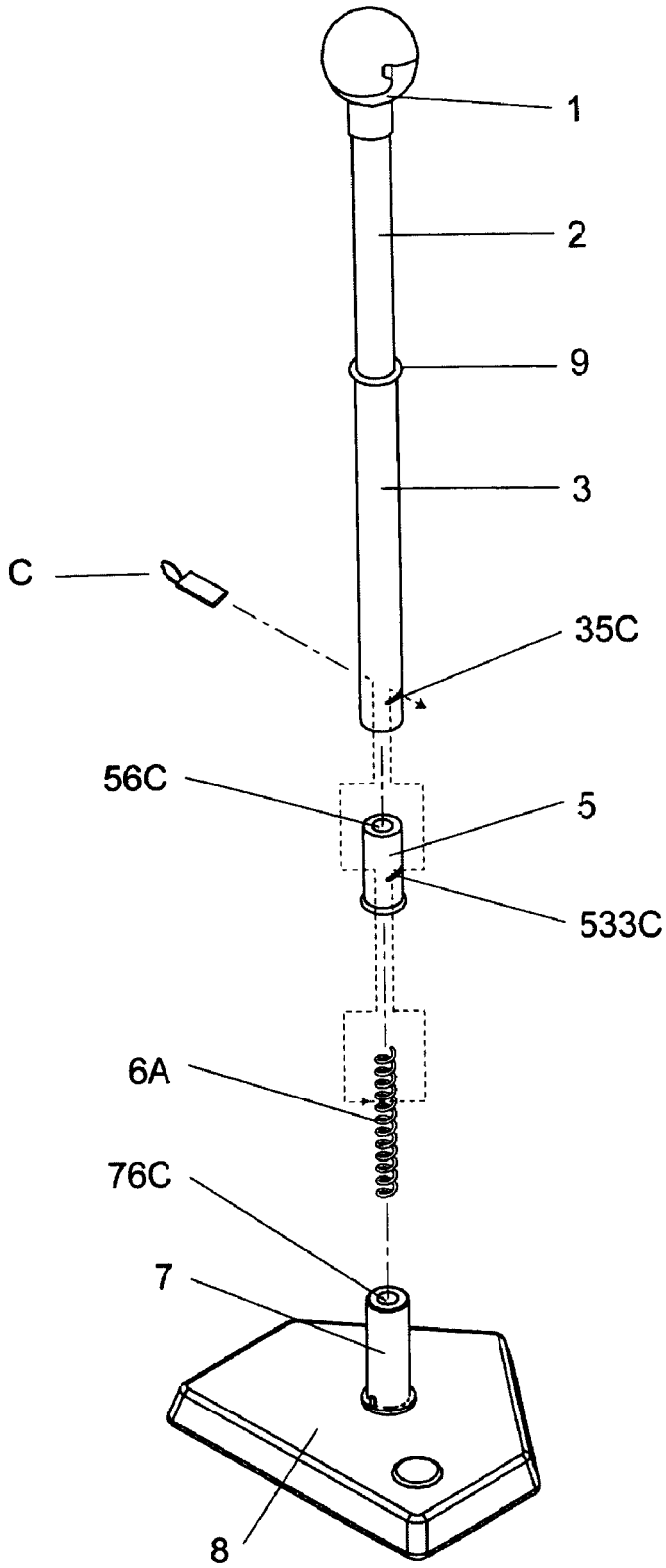
FIG. 8 is an exploded view of a second preferred embodiment of the invention with the ball being able to swing in all possible angles.
Figure 9:
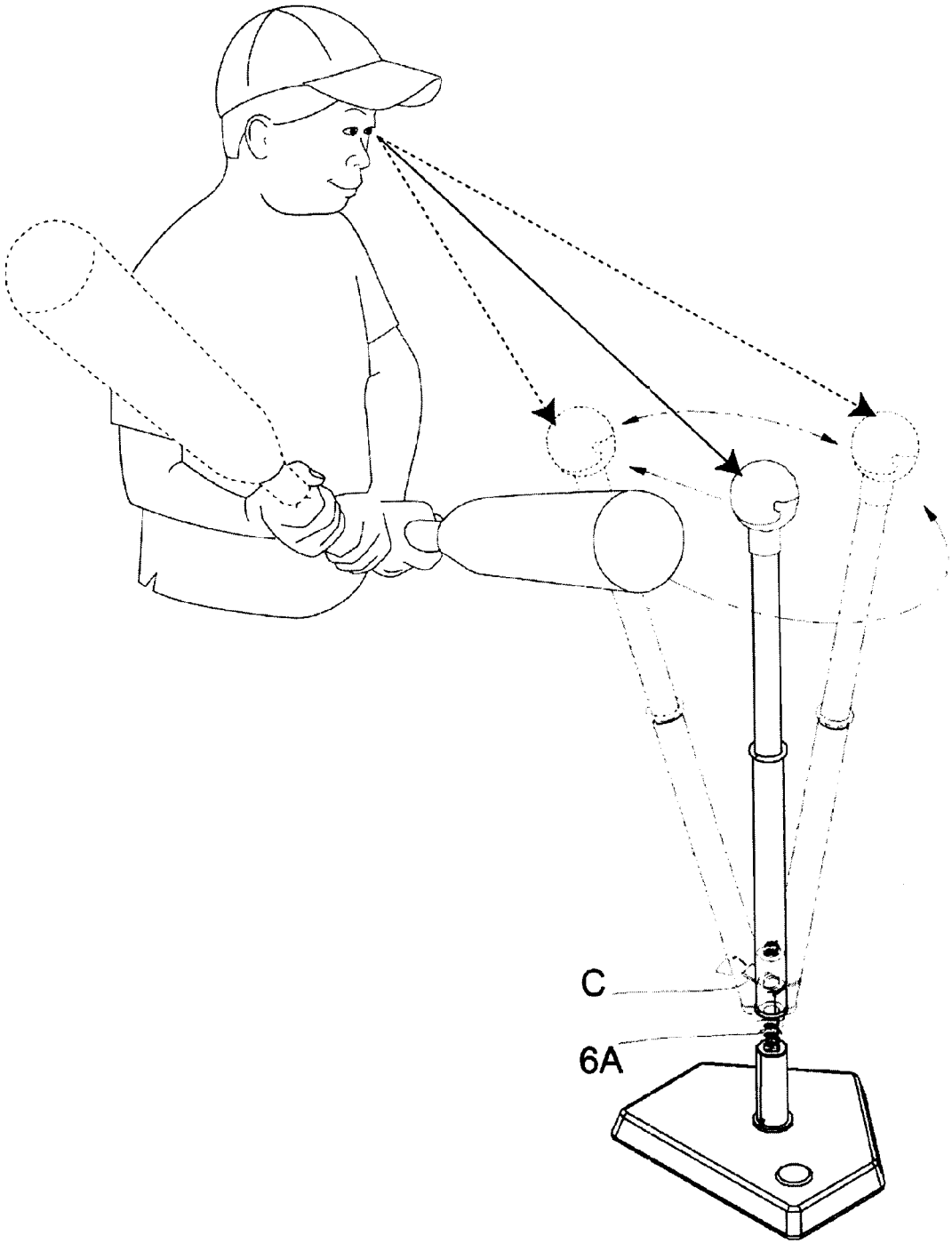
FIG. 9 illustrates the swing ball device in 360-degree motion as disclosed in the invention when in use.

Referring to FIG. 8, alternatively, the swing piece (6) can also be embodied as an elastic spring (6A) including a plurality of spring rings connected in series with an interval in between any two spring rings, with the top end of the elastic spring (6A) entering a first corresponding hollow cylinder (56C) and the bottom end of the elastic spring (6A) entering a second corresponding hollow cylinder (76C) disposed over the device seat (8).

Alternatively, the swing piece (6A) can be integrated with the lower pipe sleeve (7) in manufacturing for disposing over the device seat (8).

Alternatively, the lower connecting pipe through hole (35C) of the lower connecting pipe (3) and the upper pipe sleeve hole (533C) of the upper pipe sleeve (5) can both be implemented as of rectangular shape for securing a corresponding rectangular through-pin (C) at any intervals between spring rings, presenting a irregular dynamic swing motion in a three dimensions.

Figure 10:
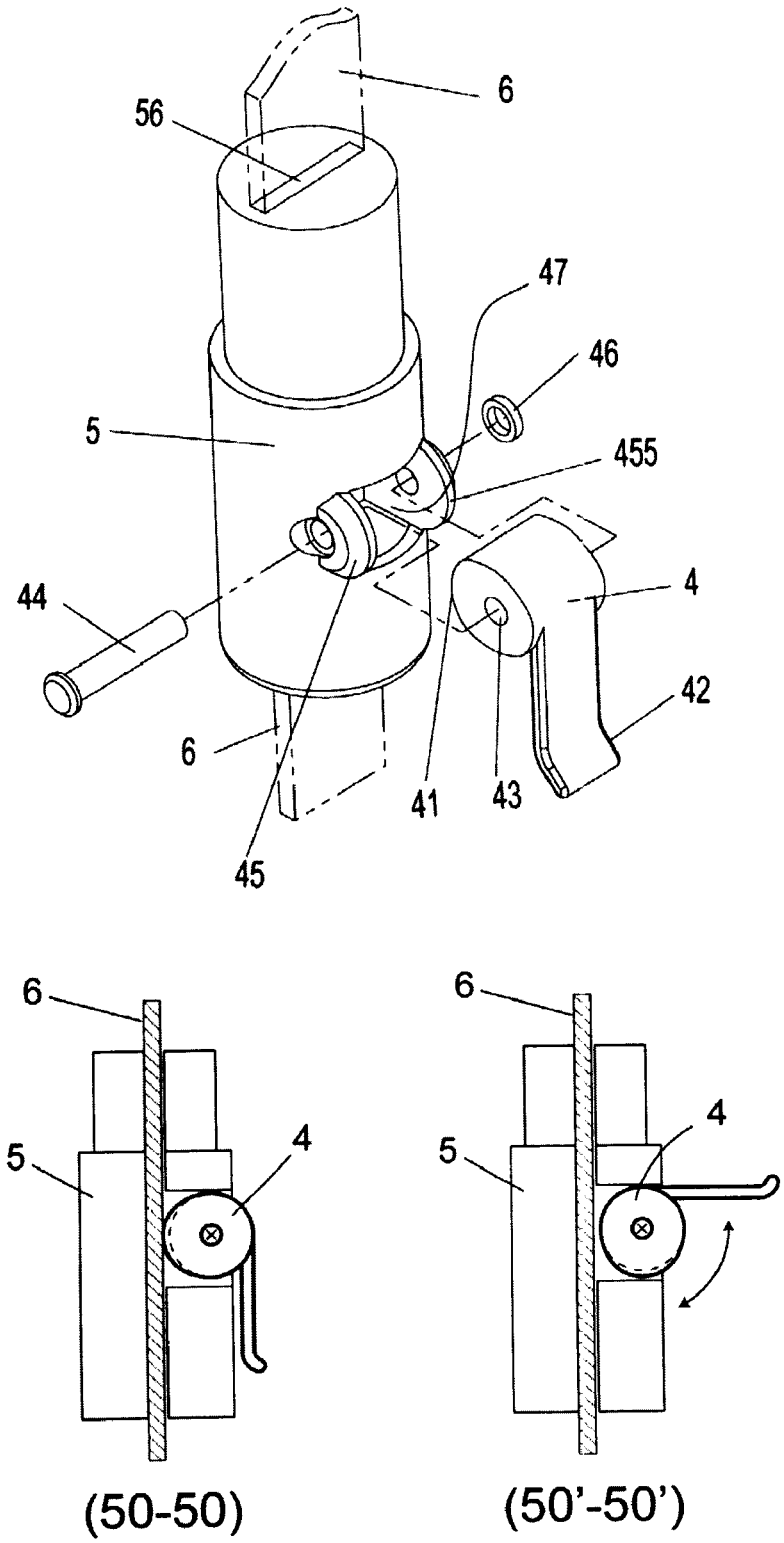
FIG. 10 illustrates the locking piece in the invention.

Referring to FIG. 10, two opposing ears (45) and (455) are disposed on a pre-determined location of the upper pipe sleeve (5) and are facing outwards. A locking piece (4) extends with a flipping handle plate (42) for manual controlling. The locking piece (4) includes a locking hole (43) for securing a locking pin (44).

A locking recess (47) is disposed in between the two opposing locking ears (45) and (455) for receiving the locking piece (4).

When the swing piece (6) enters the rectangular swing thorough slot (56) of the upper pipe sleeve (5) and is adjusted to the desired location, a user can easily flip the flipping handle plate (42) of the locking piece (4) so that the swing piece (6) would firmly press against the rectangular swing thorough slot (56), allowing for convenient adjustment for the desired positioning of the swing piece (6) in the swinging ball device, as shown in FIG. 50-50 and 50'-50'.

I claim:

1. A swing ball device with adjustable heights for hitting practice, featured with varied swing frequencies and paths to enrich training, including i) an upper connecting pipe, being hollow within;

ii) a supporting cup for receiving a ball, said supporting cup being made of soft materials, said supporting cup including ii. a) a pair of arc laterals, extending upwards from the bottom of the supporting cup, with the vertical height of the two arc laterals being greater than one-half of the diameter of the ball for securing the ball for reducing the eccentric force resulting from the swing motion of the ball during the pre-hitting initial shake and after each hit, and ii. b) a cup ring, extending upwards from the supporting cup, with the vertical height of the cup ring being less than one-fourth of the diameter of the ball for substantial exposure of the ball for hitting;

iii) a swing piece, an elastic piece with an upper end and a lower end, further including iii. a) a plurality of through interval holes for different vertical positionings of the swing piece in the swing ball device;

iv) a lower connecting pipe including a lower section and a hollow center, disposed with iv. a) a through slot for securing the lower end of the swing piece, a iv. b) an extension for positioning, and iv. c) a lower connecting pipe through hole for corresponding to the interval holes of the swing piece;

v) an upper pipe sleeve, inserted into the hollow center of the lower connecting pipe, and disposed with v. a) an extended ring at the bottom thereof for pressing against the lower section of the lower connecting pipe, v. b) an upper pipe sleeve hole, corresponding to the interval holes of the swing piece, and v. c) a center thorough hole at the center of the upper pipe sleeve for receiving the upper end of the swing piece;

vi) a lower pipe sleeve, including vi. a) a sleeve through slot for securing the lower end of the swing piece, and vi. b) a vertically oriented extension for positioning;

vii) a device seat, including vii. a) a plurality of recesses with different orientations for securing the vertically oriented extension of the lower pipe sleeve;

viii) a stopping ring, an elastic ring sleeved onto the upper connecting pipe and exposed outside of the upper connecting pipe.

2. The swing ball device for exercising as claimed in claim 1, wherein each of the two arc laterals further includes a lateral securing ear extending along the direction from the top of the arc laterals for securing the ball from falling off the supporting cup.

3. The swing ball device for exercising as claimed in claim 1, wherein said swing piece is an elastic spring or an equivalent elastic string, providing three-dimensional irregular motions of different swing frequencies and ranges.

4. The swing ball device for exercising as claimed in claim 1, wherein said upper pipe sleeve further includes a locking piece extending with a flipping handle plate for a manual controlling of said swing ball device by flipping up said flipping handle plate for releasing said swing piece, and by flipping down said flipping handle plate for pressing against said swing piece, thereby adjusting the swinging range and the positioning of said swing piece.

* * * * *